US005639015A

United States Patent [19]

Petriekis et al.

[11] Patent Number: 5,639,015

[45] Date of Patent: Jun. 17, 1997

[54] END OPENING BULK MATERIAL BOX

[76] Inventors: Paul F. Petriekis, 12603 Southwest Hwy., Palos Park, Ill. 60464; Michael Wilford, 5414 Challen Pl., Downers Grove, Ill. 60515

[21] Appl. No.: 473,095

[22] Filed: Jun. 7, 1995

Related U.S. Application Data

[63] Continuation-in-part of Ser. No. 253,955, Jun. 3, 1994, Pat. No. 5,419,485.

[51] Int. Cl.[6] ..... B65D 5/32; B65D 5/54

[52] U.S. Cl. ..... 229/23 R; 220/465; 229/243; 229/918; 229/919

[58] Field of Search ..... 220/462, 465; 229/23 R, 23 C, 240, 242, 243, 244, 915, 918, 919

[56] References Cited

U.S. PATENT DOCUMENTS

| | | | |
|---|---|---|---|
| 2,606,709 | 8/1952 | Carey et al. | 229/23 R |
| 2,823,846 | 2/1958 | George | 229/23 R |
| 3,099,379 | 7/1963 | Stease | 229/23 R |
| 3,214,076 | 10/1965 | Gagnon | 229/23 R |
| 3,253,764 | 5/1966 | Goetschius et al. | 229/17 |
| 3,756,471 | 9/1973 | Wissman | 220/465 |
| 3,905,541 | 9/1975 | Paxton | 229/23 R |
| 3,993,239 | 11/1976 | Exel | 229/23 R |
| 4,549,673 | 10/1985 | Kupersmit | 220/465 |
| 4,793,494 | 12/1988 | Gordon, Jr. | 229/23 R |
| 4,815,631 | 3/1989 | Eeg et al. | 220/403 |
| 4,986,466 | 1/1991 | Colby | 229/126 |
| 5,054,644 | 10/1991 | Greenslade | 220/403 |
| 5,143,278 | 9/1992 | Petriekis et al. | 229/23 |
| 5,265,753 | 11/1993 | Moorman | 220/465 |
| 5,333,777 | 8/1994 | Roth | 229/23 R |
| 5,335,844 | 8/1994 | Young | 229/23 R |

*Primary Examiner*—Gary E. Elkins
*Attorney, Agent, or Firm*—Wallenstein & Wagner, Ltd.

[57] ABSTRACT

An end opening bulk material container having a plurality of sidewalls defining a polygonal-shaped sleeve, the sleeve has a depth dimension greater than its width dimension, a first end of the sleeve is closed by a first end wall and two sets of parallel supports, one of each is associated with separate sidewalls.

35 Claims, 12 Drawing Sheets

100
106
108
210
6
30
32
34
36
38
40
46
48
62
64
66
68
70
72

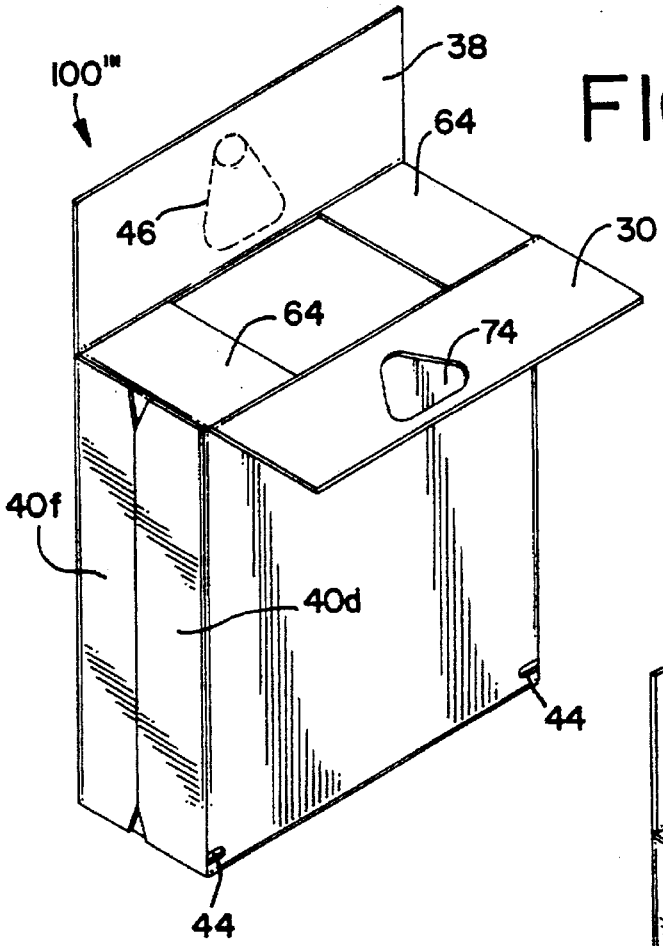
FIG. 20
FIG. 21
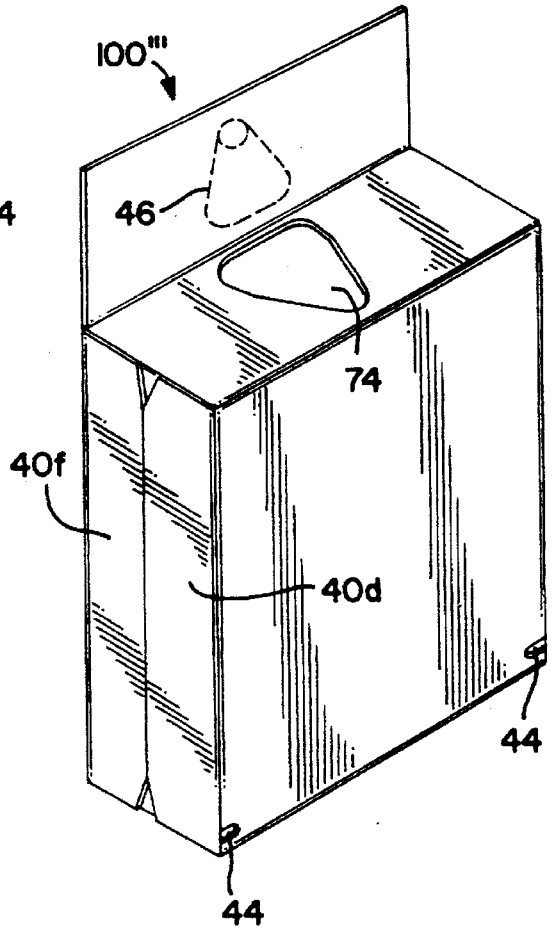
FIG. 22
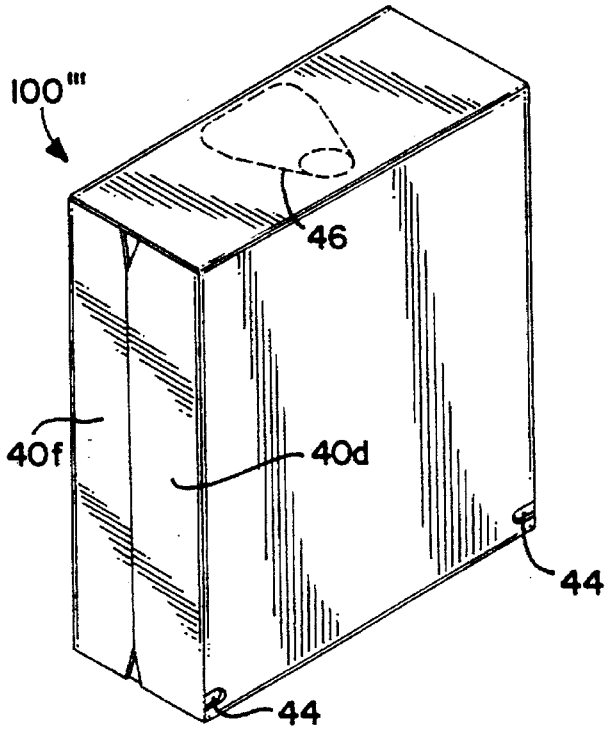

END OPENING BULK MATERIAL BOX

This application is a continuation-in-part of Ser. No. 08/253,955, now Pat. No. 5,419,485, filed Jun. 3, 1994.

TECHNICAL FIELD

The present invention relates generally to bulk material containers and specifically to reinforced corrugated flat-board containers for shipping liquid filled bags.

1. Background of the Invention

Liquid products such as soft drink syrup or chemical products are often shipped in small volumes such as five gallon portions. These liquid volumes may be packaged in a plastic bag and housed within a paperboard container to protect the bag from puncture or compression. This method of packaging is often referred to as "bag in box." The bag is often provided with a fitment or a spout and the box with a corresponding access door to allow access to the contents of the bag through a wall of the box.

Prior boxes that have been specially designed to enclose and transport these five gallon bags usually are six sided boxes folded from a single sheet of corrugated paper that is folded and glued along a single glue lap to an outside wall of the box. The boxes usually have bottom and top walls that are formed from the overlap of major and minor flaps, and the box usually folds flat for storage. The boxes also have a perforated section along an end wall that may be removed to accommodate the spout so that liquid may be removed from the bag without opening the top of the box.

However, these prior boxes have presented several problems to manufacturers and distributors. For example, distributors have discovered that these boxes have insufficient structural support and that movement of the liquid filled bag within the box may cause the box to unfold or breakdown during warehousing and distribution. Further, the boxes have inadequate stacking strength and may crush, or have its perforated spout break out or the box may otherwise be damaged under the weight of a palletized load. In more serious cases where the perforated spout breaks out, a tear may form in a side or end panel of the box and continue along paperboard corrugations causing the box to rip open. In these cases, the box is rendered incapable of protecting the contents of the bag from outside hazards.

Manufacturers and distributors have also encountered problems with this box. For example, the glue lap that was provided to hold prior boxes together, oftentimes became unglued during the loading of the box with a liquid filled bag causing the entire box to unfold. Further, the manufacturers have had difficulty in detecting leaks in these boxes until after the boxes have been filled and prepared for shipment or actually shipped. Manufacturers have also had difficulty, in loading the prior boxes, to get the liquid filled bags to cover the entire bottom of the box for even weight distribution.

Improvements have been made to the single piece containers by constructing a container from three separate pieces of corrugated paperboard. An example of such a container is disclosed in U.S. Pat. No. 5,143,278 which is assigned to the owner of the present invention and is incorporated herein by reference. The '278 Patent discloses a top loaded container which has reinforcing flanges that add considerable support to the container far in excess of single piece boxes. However, even the container disclosed in the '278 Patent must be stacked on a pallet with each box in conformation with the lower box, that is sidewall over sidewall and end wall over end wall, in a column stacking pattern to avoid damaging the container on panels 32 and 36 between side flanges 120.

For these reasons, it is desirable to produce a more cost effective box for shipping liquid filled bags, that has greater stacking strength than boxes presently being used so that the boxes may be stacked on a pallet in an interlocking fashion, that is one box may be placed transverse to a lower box, or shipped in single increments by common courier such as U.P.S.

2. Related Applications

This is a continuation-in-part application of U.S. patent application identified by Ser. No. 08/253,955.

SUMMARY OF THE INVENTION

The present invention provides a reinforced corrugated paper box and corrugated paper blanks for forming the box that may be used for the shipment of liquid filled bags, and other bulk material.

According to the present invention, a container is provided comprising a plurality of sidewalls defining a polygonal shaped sleeve. Preferably, there are four sidewalls defining a rectangular sleeve. The sleeve has first and second ends, inner and outer surfaces, and a depth and a width dimension. The depth dimension is greater than the width dimension. The sleeve has a smooth inner surface. A first end wall located at the first end of the sleeve closes the first end of the sleeve. At least two sets of parallel supports (each having a pair of legs) or two C-shaped supports (each formed from two legs and a side flap) extend from the first end of the sleeve toward the second end of the sleeve along a periphery of two opposed sidewalls.

Each sidewall of the container has a top flap hingedly connected thereto, each of the top flaps being folded to form a second end wall to close the second end of the sleeve. The first and second end walls are parallel to an axis of stacking of the container and provide additional support to the container.

An access door is provided in an end wall, preferably the second end wall, to allow access to the contents of a bag stored within the container. The door has a detachable section that preferably is circular in shape.

Preferably, the box has one or two holes in one of the walls of the container. These holes allow for the passage of air and liquid. Consequently, when a liquid filled bag is dropped into the box, air is displaced through the hole or holes allowing the contents of the bag to evenly distribute over the second end wall of the box. Also, the holes allow for early leak detection by allowing liquid to pass out of the box immediately after the leak occurs.

The present invention also provides for a system for forming the container described above. The system includes corrugated paper blanks for cooperatively forming the present container. To form the preferred rectangular container, the blanks comprise an elongate body blank with opposed lateral sides, and two side blanks each having opposed lateral sides, and opposed top and bottom ends. The container may also be formed using one side blank with two top ends, two lateral sides, and one bottom end. Transverse fold lines extending between the opposed lateral sides of the body blank divide the body blank into a first, a second, a third, a fourth and a fifth panel. Body flanges extend from the opposed lateral sides of the body blank from the second, third and fourth panel. These body flanges attach the body blank to the side blanks.

The side blanks preferably have top and bottom closing flaps that are foldable to form supports parallel to the stacking access of the container. Preferably the side blanks are made from two ply corrugated paperboard.

The three piece construction of the container allows one to interchange the stock of material used to build the container. For example, one could use a single ply corrugated paper for the body blank, and a double ply corrugated paper for the side blanks. The double ply corrugated paper sidewalls will add substantial structural support to the box.

BRIEF DESCRIPTION OF DRAWINGS

FIG. 20 is a perspective view of an alternate embodiment of the container constructed using the body blank shown in FIG. 18 and the side blank shown in FIG. 19, with the minor flaps folded to a closed position;

FIG. 21 is a perspective view of an alternate embodiment of the container constructed using the body blank shown in FIG. 18 and the side blank shown in FIG. 19, with one major flap and both minor flaps folded to a closed position;

FIG. 22 is a perspective view of an alternate embodiment of the container constructed using the body blank shown in FIG. 18 and the side blank shown in FIG. 19, with both major and minor flaps folded to a closed position;

DETAILED DESCRIPTION

Figure 1:
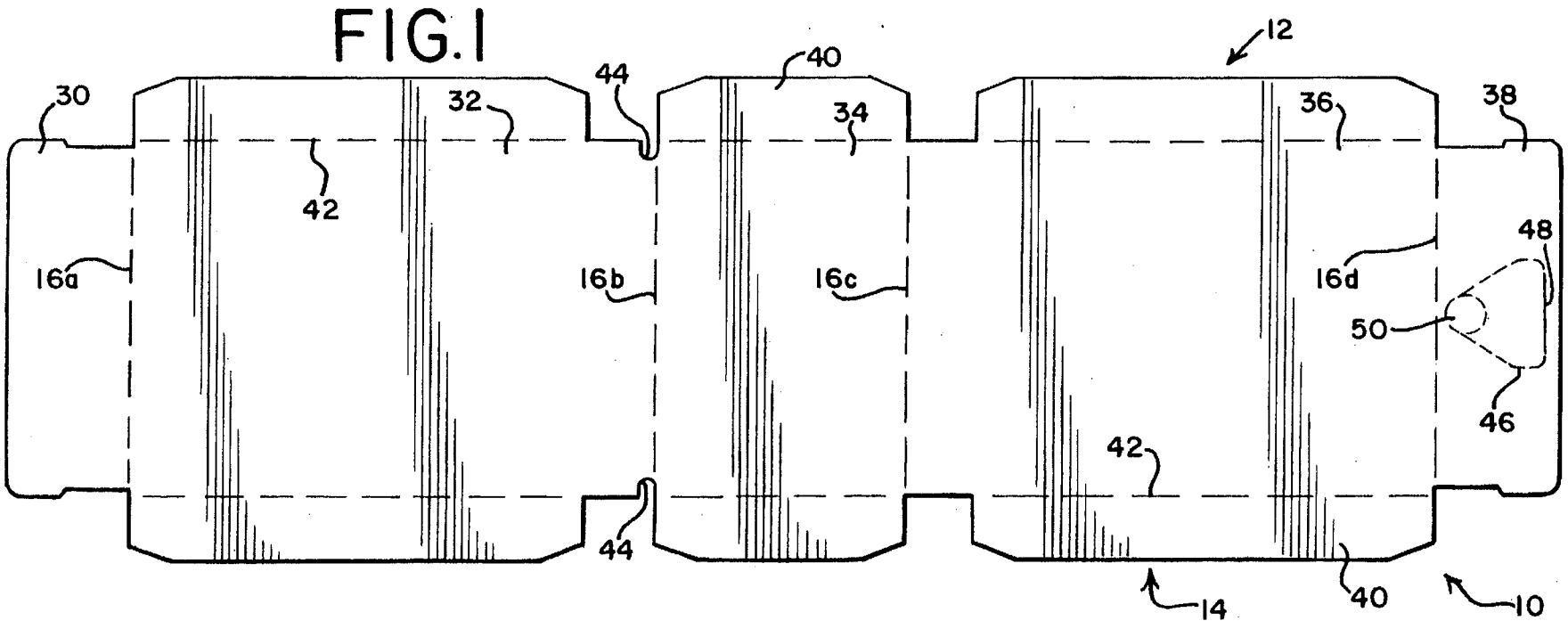
FIG. 1 is a top view of an elongate body blank of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 shows an elongate body blank 10 having first and second lateral sides 12 and 14. Transverse fold lines **16*a–d* extend between the first and second lateral sides 12 and 14 to define a first, a second, a third, a fourth, and a fifth panel 30, 32, 34, 36, and 38. The body blank 10 may be folded along the transverse fold lines 16*a–d* to form a C-shaped sleeve. Preferably the body blank 10** is made from single-ply corrugated paperboard.

Body flanges 40 extend from the first and second lateral sides 12 and 14 of the body blank 10 at the second, third, and fourth panels, 32, 34, and 36. Marginal fold lines 42 separate the body flanges 40 from the body blank 10.

Notches 44 are removed from the first and second lateral edges 12 and 14 of the body blank 10 at the intersection of the second and third panels 32 and 34. The notches 44 provide a hole in the assembled container to allow for the passage of liquid and air.

The fifth panel 38 has a centrally located perforated section defining an access door 46. An upper portion of the door is not perforated so that it may function as a hinge 48. A circular shaped perforated section 50 at a distal end of the door 46 may be completely detached from the body blank 10 to form a circular hole. In the fully assembled container, the circular section 50 may be removed and the access door 46 pivoted outward to provide access to a fitment or spout of a bag (not shown) located within the assembled container. This access door 46 is not required when the assembled container is not used to ship liquid filled bags.

Figure 2:
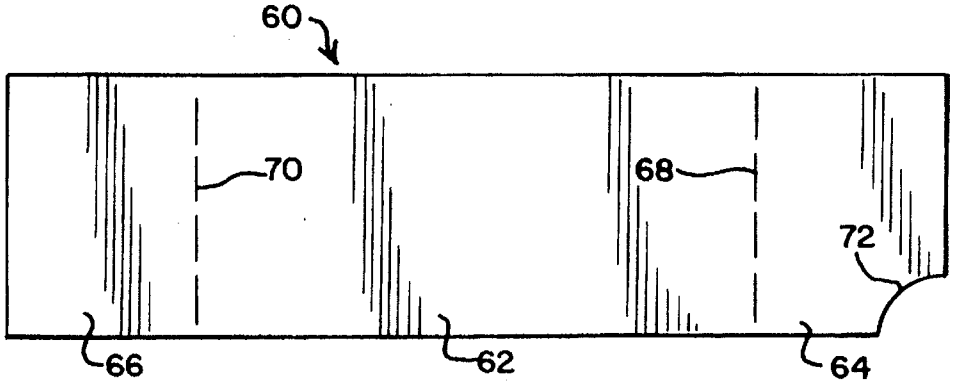
FIG. 2 is a top view of the side blank of the present invention.

FIG. 2 shows a side blank 60 made of corrugated paperboard having a central panel 62 and top and bottom flaps 64 and 66 hingedly connected to the central panel 62 along respective creases 68 and 70. The top flaps 64 may sometimes be referred to as minor flaps. A notch 72 is removed from a portion of the minor flap 64 to accommodate the passage of a spout of a bag enclosed within an assembled container. Preferably, the side blank is made from double ply corrugated paper for increased structural support. Further, preferably the paperboard corrugations extend laterally so that top and bottom flaps 64 and 66 fold more easily along creases 68 and 70.

To erect a container 100 (FIG. 3) from the body blank 10 and the side blank 60 one must use one body blank 10 and two side blanks 60. The body blank 10 is folded along the fold lines 16*b* and 16*c* to form a C-shaped sleeve. Two side blanks 60 are inserted into the C-shaped sleeve at opposite lateral edges 12 and 14 of the body blank adjacent the marginal fold lines 42. Panels 32 and 36 and panels 62 (which sometimes may be referred to as sidewalls) of side blanks 60 define a rectangular sleeve 73. The rectangular sleeve 73 has first and second ends 102 and 104, and a depth and width dimension 106 and 108. The depth dimension 106 should be greater than the width dimension 108. (See FIG. 3).

Figures 3, 4, 6:
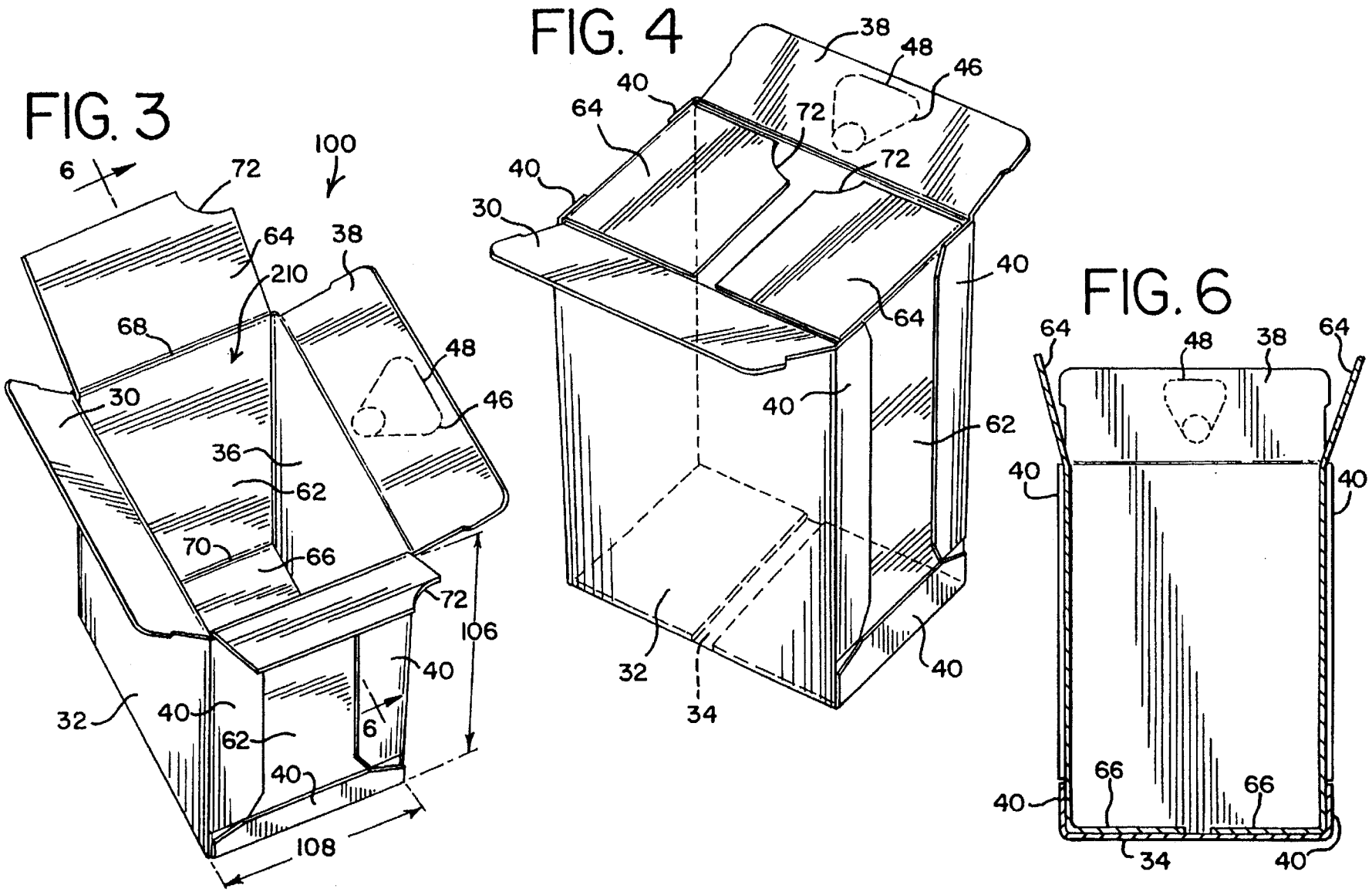
FIG. 3 is a perspective view of the container of the present invention in an open position.
FIG. 4 is a perspective view of the container of the present invention with minor flaps folded to a closed position.
FIG. 6 is a cross-section taken along line 6–6 of FIG. 3.

The bottom flaps 66 of each of the side blanks 60 are folded inward along creases 70 and the bottom flaps 66 are attached to an inner surface of panel 34 (which sometimes may be referred to as the first end wall as it closes the first end of the rectangular sleeve 73) by gluing to form a double end wall. (FIG. 6). The notches 72 of the side blank 60 must each be facing panel 38 so that when folded inward to close the container they are in alignment with the access door 46. These notches are not required when the erected container is not used for shipping liquid filled bags.

The body flanges 40 along each lateral edge 12 and 14 of the body blank 10 are then folded inward along the marginal fold line 42 and attached to respective side blanks 60 by gluing. The flanges 40 form C-shaped supports 61 along a periphery of each of the side blanks 60, two of the legs 75 of the C-shaped support extend from the first end 102 of the rectangular sleeve 73 toward the second end 104 of the sleeve 73.

Figure 5:
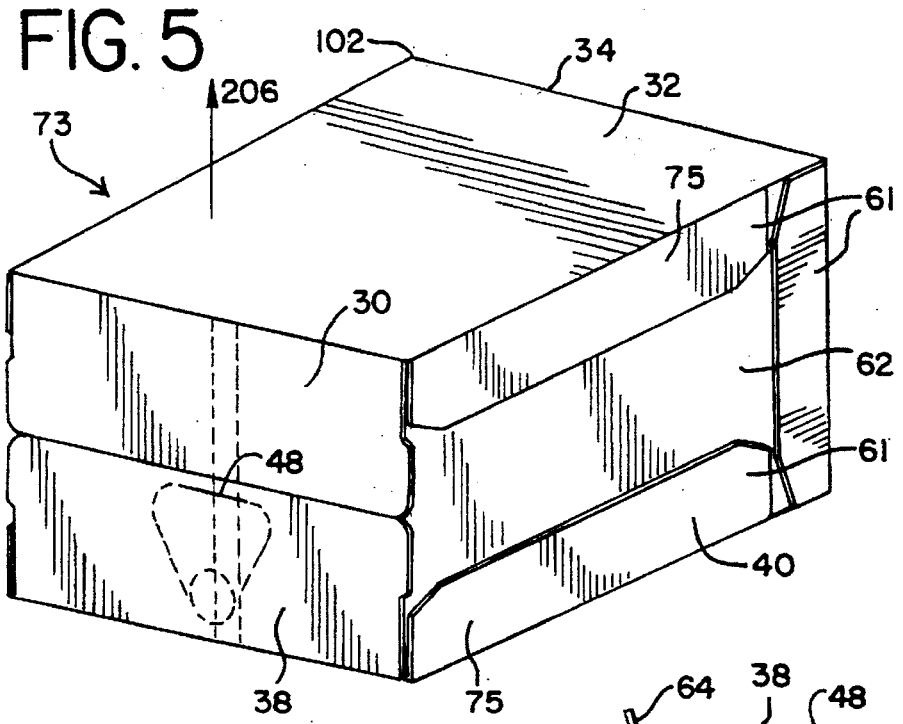
FIG. 5 is a perspective view of the container of the present invention with both major and minor flaps folded to a closed position.

To close the second end 104 of rectangular sleeve 73 of the container 100, the minor flaps 64 of the side blank 60 are folded inward of the sleeve 73 along the fold lines 68 (FIG. 4). Then panels 30 and 38 which may be referred to as major flaps, are folded inward on top of the minor flaps 64 and glued thereto (FIG. 5) to close the container 100. If there is no access door 46 on container 100, the second end 104 of the sleeve 73 may also be closed by initially folding panels 30 and 38 inward before folding minor flaps 64.

When the container 100 is used to package a liquid filled plastic bag (not shown), the minor flaps 64 act as a plow to push the bag into the container 100 after loading. Further, the minor flaps 64 also serve to shield the bag from the damaging effects caused by contact with hot glue during the process of gluing the major flaps 30 and 38 to the minor flaps 64.

Figure 7:
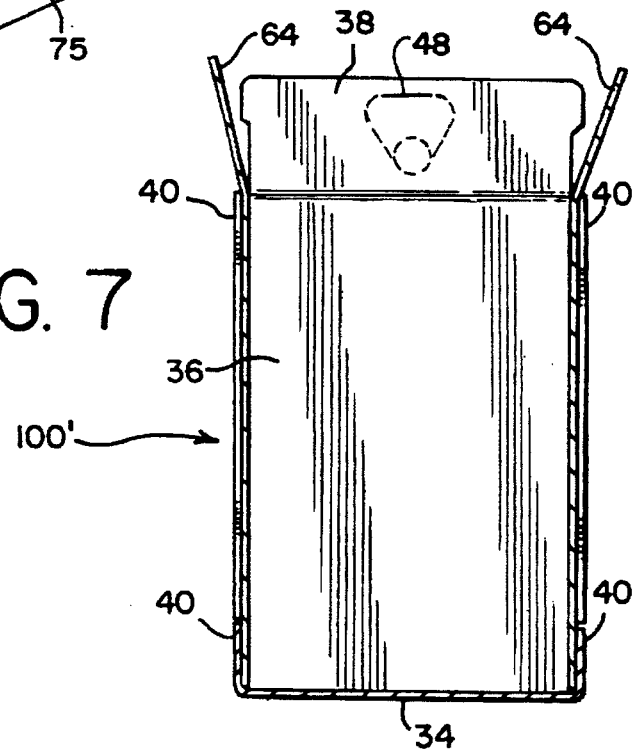
FIG. 7 is a cross-section of an alternate embodiment of the container of the present invention.
Figure 8:
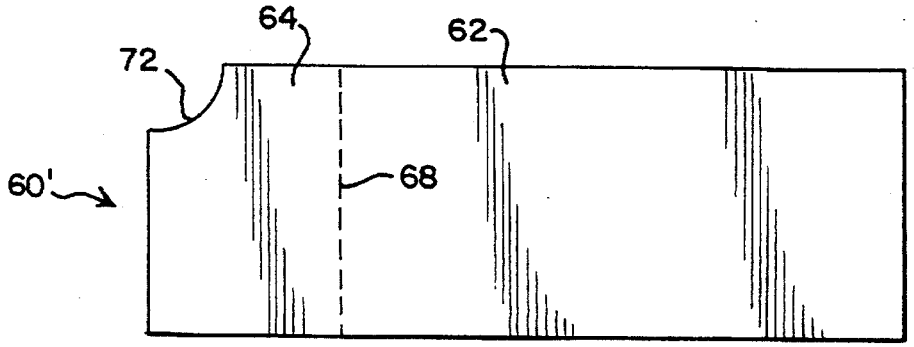
FIG. 8 is a top view of an alternate embodiment of the side blank for constructing the container of FIG. 7.

In an alternate embodiment of the container 100', side blanks 60' shown in FIG. 8 are used instead of the side blank 60 shown in FIG. 2. Unlike side blank 60 (FIG. 2), side blank 60' does not include bottom flaps 66. Therefore, the first end wall 34 is of single thickness instead of double thickness. (FIG. 7). In all other respects the containers are the same; thus, the same numerical designations are used for corresponding parts.

Figure 11:
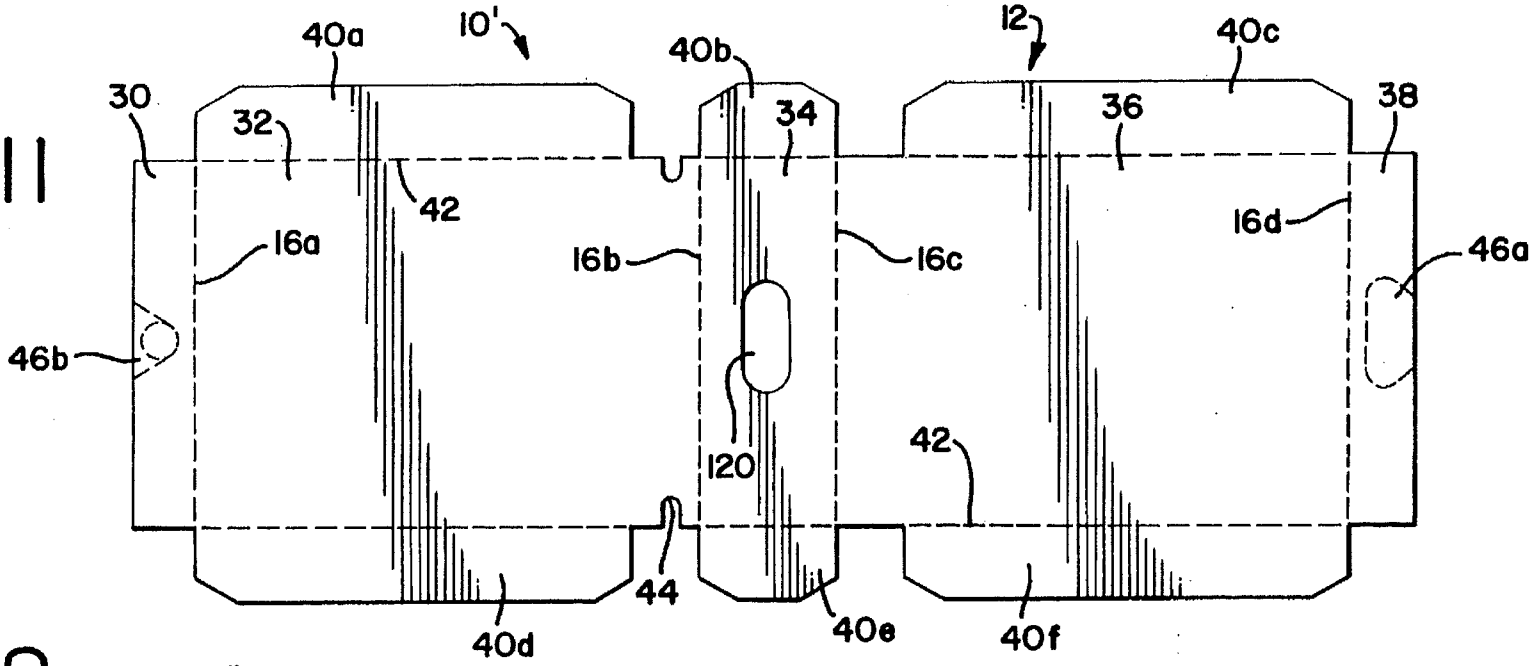
FIG. 11 is a plan view of an alternate embodiment of a body blank.
Figure 12:
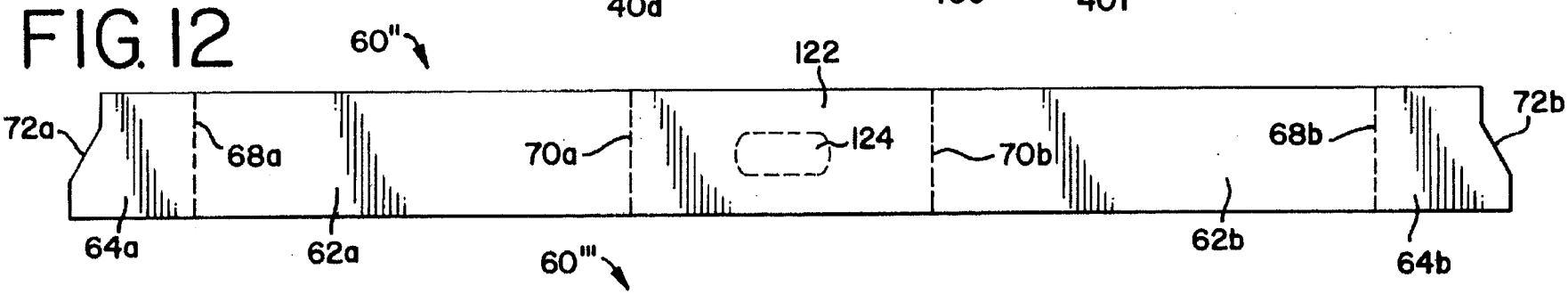
FIG. 12 is a plan view of an alternate embodiment of a side blank.
Figure 14:
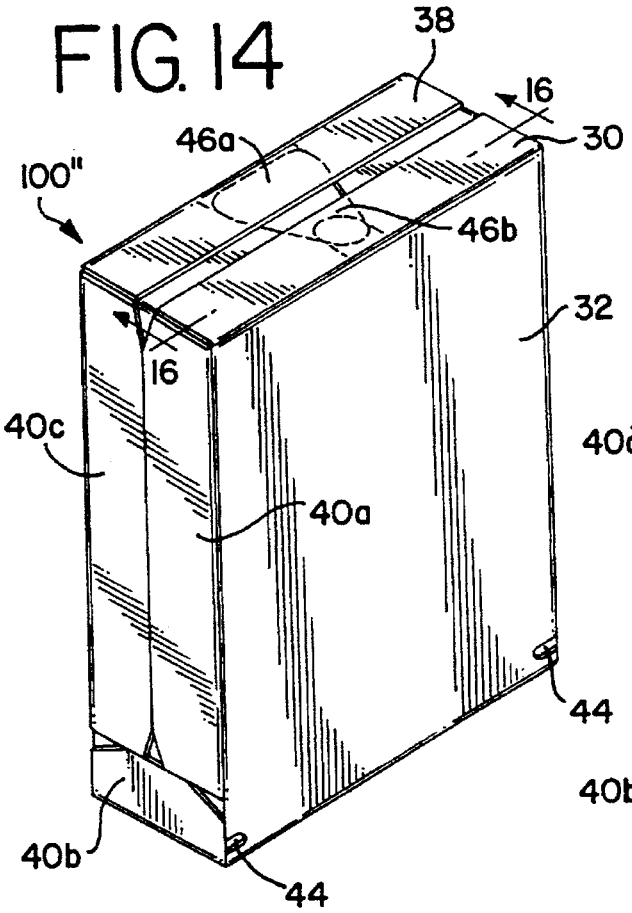
FIG. 14 is a perspective view of an alternate embodiment of a container constructed using the body blank shown in FIG. 11.

A second alternate embodiment, container 100" is shown in FIG. 14. Container 100" is constructed from body blank 10', shown in FIG. 11, and single side blank 60", shown in FIG. 12, in essentially the same manner as described above with respect to container 100. Unlike body blank 10, body blank 10' has an oblong shaped hole 120 on panel 34. Further, access door 46 is cooperatively formed by portions 46*a* and 46*b* located on respective panels 38 and 30. For the sake of further clarity, body flanges 40 are more particularly referred to as 40 a–f.

Figure 16:
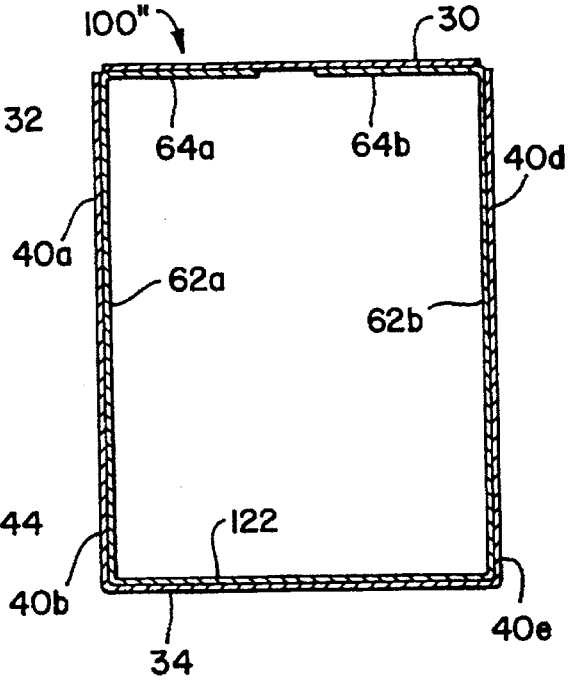
FIG. 16 is a section view taken along line 16—16 of FIG. 14.

Unlike prior side blanks 60 and 60' that have required the use of two side blanks 60 for each body blank 10 to construct a container 100, only one side blank 60" per body blank 10' is required (FIG. 16). Side blank 60" has side panels 62*a* and 62*b*, and an end panel 122. End panel 122 has a centrally disposed frangible section 124. Frangible section 124 overlays hole 120 of panel 34, when constructed as a container 100", to define a positioning handle.

Figure 15:
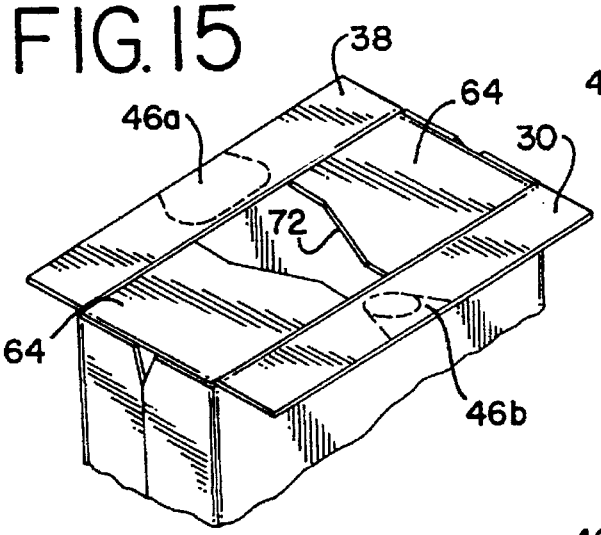
FIG. 15 is a perspective view, partially broken away, of a container constructed using the side blanks shown in FIGS. 12 and 13.

Side blank 60" has notches 72*a* and 72*b* removed, as do side blanks 60 and 60' Notches 72*a* and 72*b* generally conform to the outer contours of access door 46 as shown in FIG. 15. The shape of notches 72*a* and 72*b* minimize the deleterious effects that may be caused by removal of paperboard to the structural integrity of the container. The shape of notches 72*a* and 72*b* also assists in minimizing the quantity of scrap material.

Figure 13:
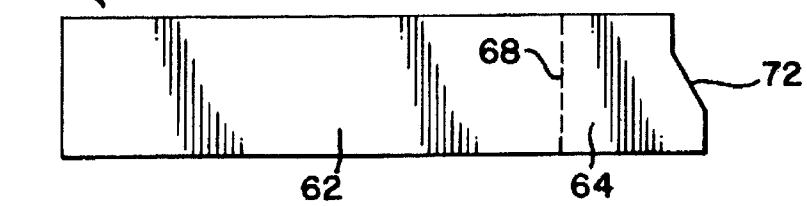
FIG. 13 is a plan view of an alternate embodiment of a side blank.
Figure 17:
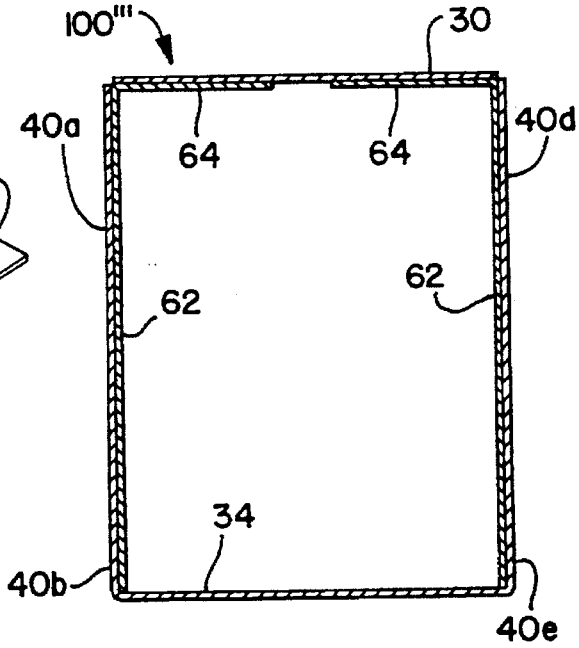
FIG. 17 is a section view of a container having an end wall of single wall thickness.

FIG. 13 shows yet another embodiment of side blank 60'". Side blank 60'" differs from side blank 60' in the shape of notch 72. In all other respects 60'" is the same as 60' and may be used in the same fashion as 60' to construct a container 100'" as shown in FIG. 17.

Figure 18:
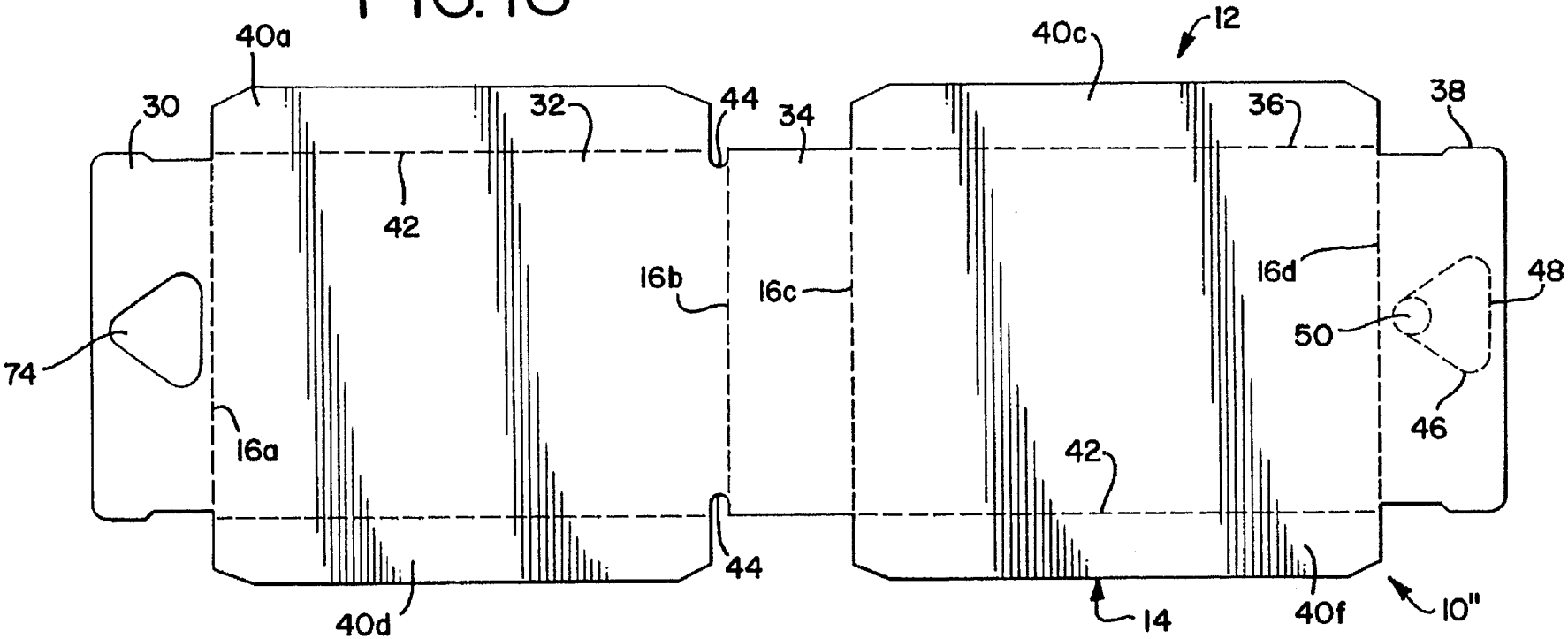
FIG. 18 is a plan view of an alternate embodiment of a body blank.
Figure 19:
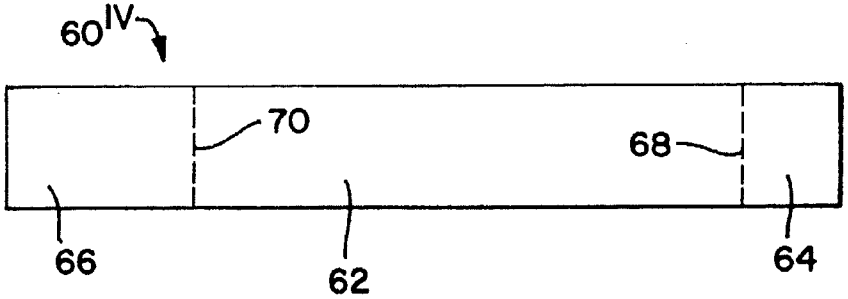
FIG. 19 is a plan view of an alternate embodiment of a side blank.

FIGS. 20–22 show another embodiment of container 100'" of the present invention. Container 100'" is constructed from body blank 10", shown in FIG. 18, and body blanks $60^{IV}$, shown in FIG. 19. Unlike container 100, container 100'" has four flanges (40*a*, 40*c*, 40*d*, 40*f*) to form parallel supports, rather than the C-shaped supports shown in FIG. 5. Also, there is a full overlap of fifth panel 38 over first panel 30. Access door 46 in container 100'" overlays an aperture 74 in the first panel, to allow access to the contents of the bag. Minor flaps 64 are short enough so that they do not interfere with the passage of the spout of the bag through access door 46. FIGS. 20–22 show container 100'" with both minor flaps folded to a closed position, with one major flap and both minor flaps folded to a closed position, and with both major and minor flaps folded to a closed position, respectively.

Figure 23:
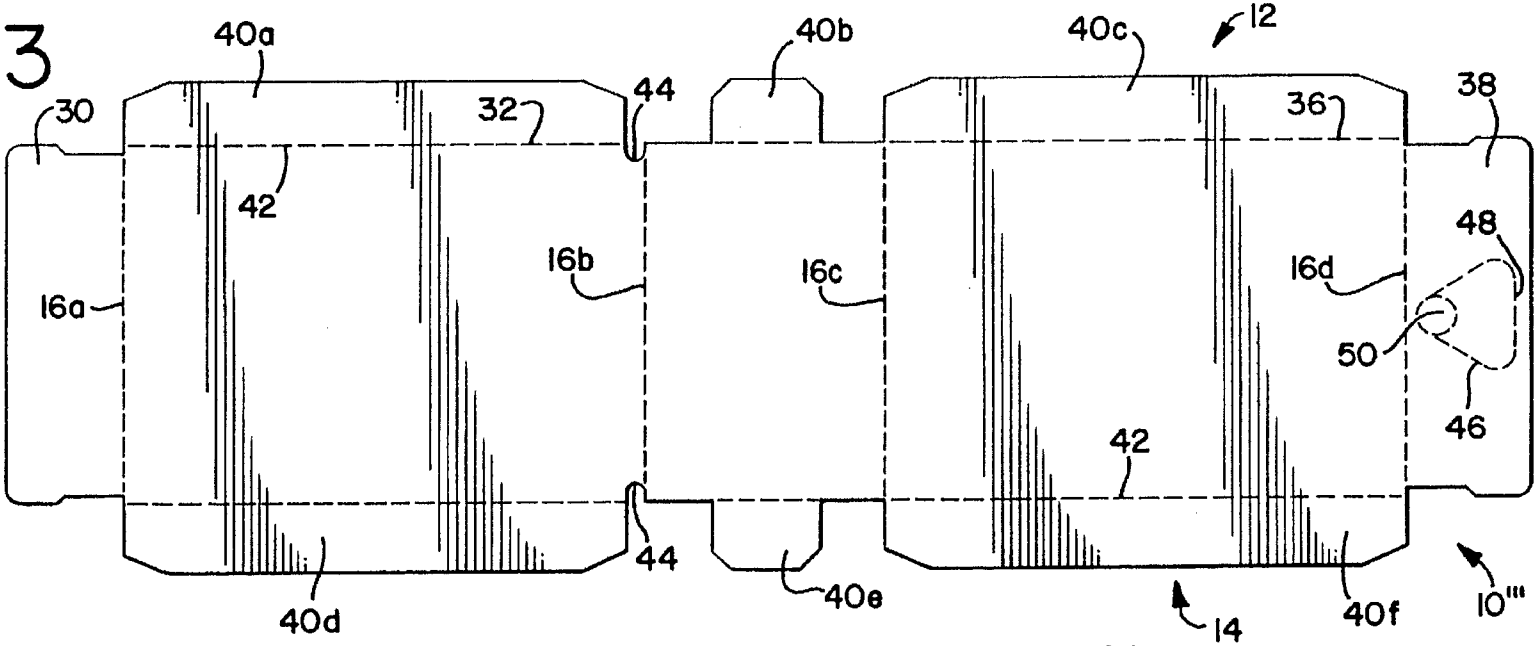
FIG. 23 is a plan view of an alternate embodiment of a body blank.
Figure 24:
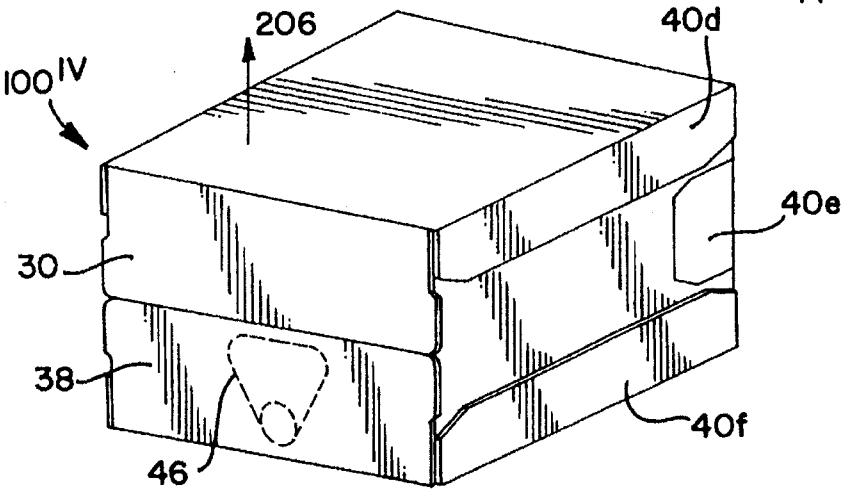
FIG. 24 is a perspective view of an alternate embodiment of the container constructed using the body blank shown in FIG. 23.

FIG. 24 shows another embodiment of the container $100^{IV}$ of the present invention, constructed from body blank 10'", shown in FIG. 23. The difference between container $100^{IV}$ and container 100 is in the C-shaped support. Whereas flanges 40*b* and 40*e* in container 100 extend throughout the width of container 100, in container $100^{IV}$, flange 40*b* lies between flanges 40*a* and 40*c*, and flange 40*e* lies between flanges 40*d* and 40*f* respectively.

Figures 25, 26, 27:
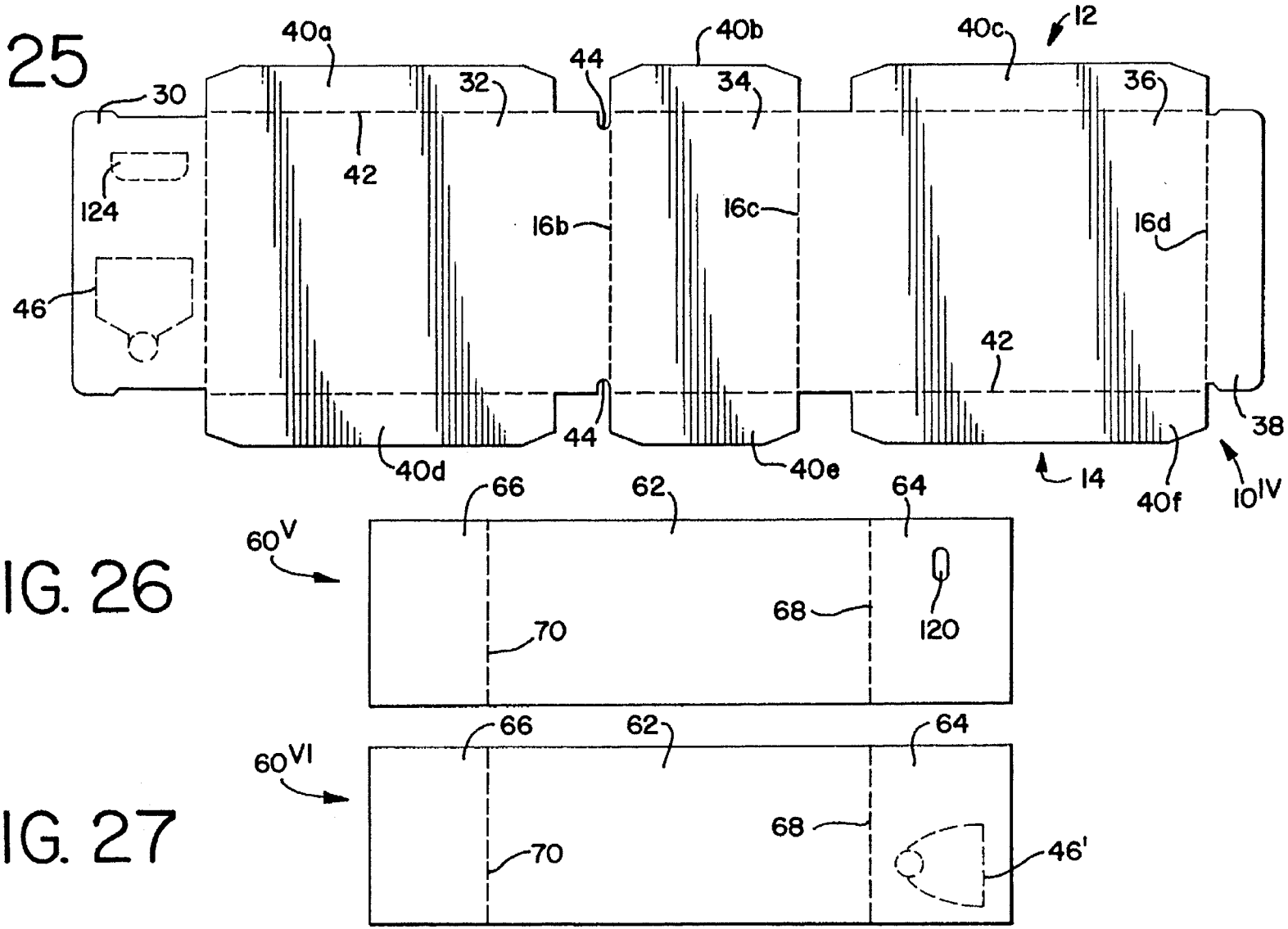
FIG. 25 is a plan view of an alternate embodiment of a body blank.
FIG. 26 is a plan view of an alternate embodiment of a side blank.
FIG. 27 is a plan view of an alternate embodiment of a side blank.
Figure 29:
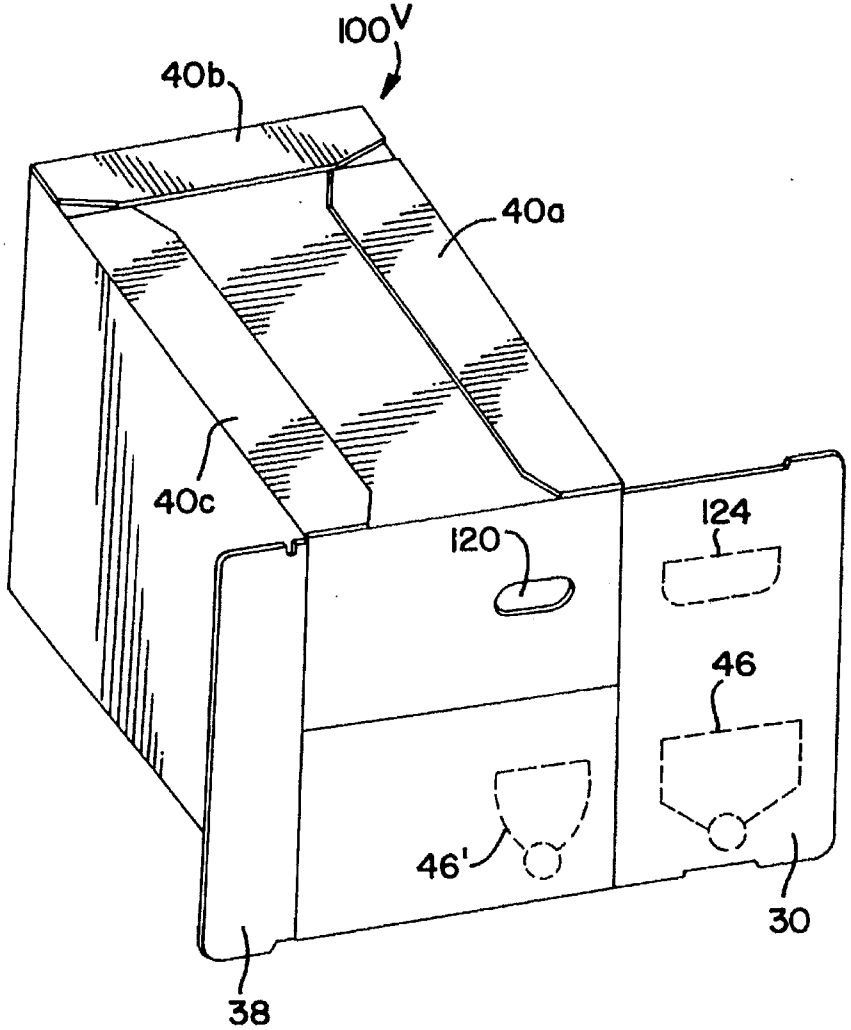
FIG. 29 is a perspective view of an alternate embodiment of the container constructed using the body blank shown in FIG. 25 and the side blanks shown in FIGS. 26 and 27, with the minor flaps folded to a closed position.
Figure 28:
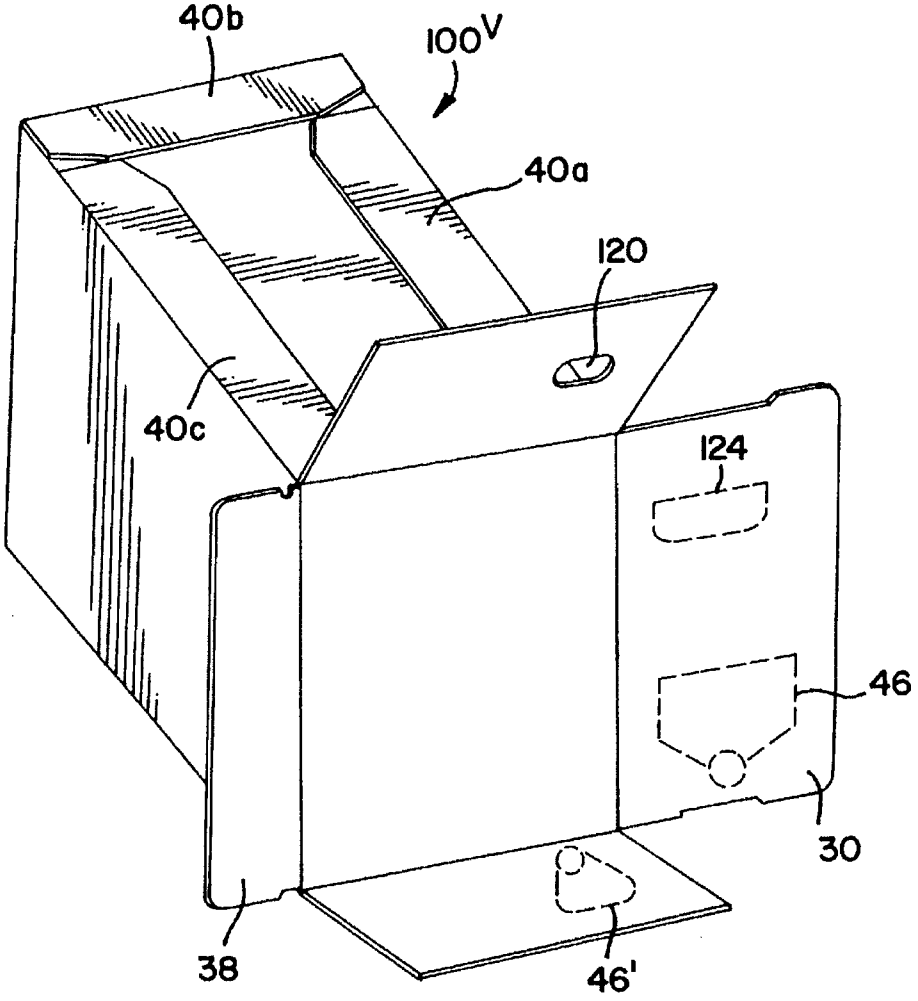
FIG. 28 is a perspective view of an alternate embodiment of the container constructed using the body blank shown in FIG. 25 and the side blanks shown in FIGS. 26 and 27, in an open position.
Figure 30:
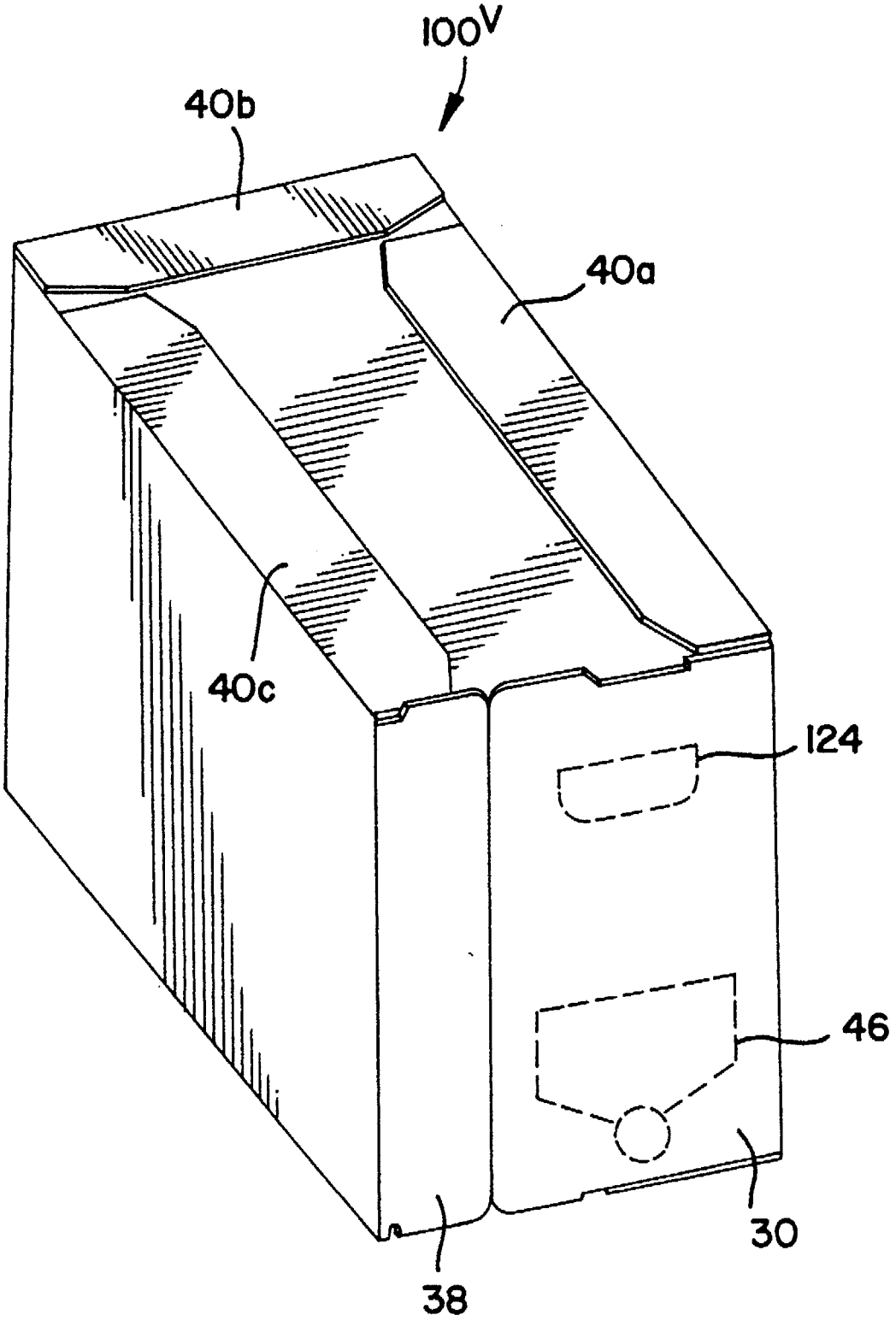
FIG. 30 is a perspective view of an alternate embodiment of the container constructed using the body blank shown in FIG. 25 and the side blanks shown in FIGS. 26 and 27, with both major and minor flaps folded to a closed position.

FIGS. 28–30 show another embodiment of container $100^{V}$, constructed from body blank $10^{IV}$, shown in FIG. 25 and body flanges $60^{V}$ and $60^{VI}$, shown in FIGS. 26 and 27, respectively. First panel 30 in body blank $10^{IV}$ is wider than fifth panel 38, and has both access door 46 and frangible section 124. Side blank $60^{VI}$ also has an access door 46' to correspond with access door 46. Access doors 46 and 46' act as a double lock to anchor the spout of the bag within access doors 46 and 46'. Frangible section 124 overlays an oblong shaped hole 120 in side blank $60^{V}$ to define a positioning handle above access door 46. FIGS. 28–30 show container $100^{V}$ in an open position, with both minor flaps folded to a closed position, and with both major and minor flaps folded to a closed position, respectively.

Figure 10:
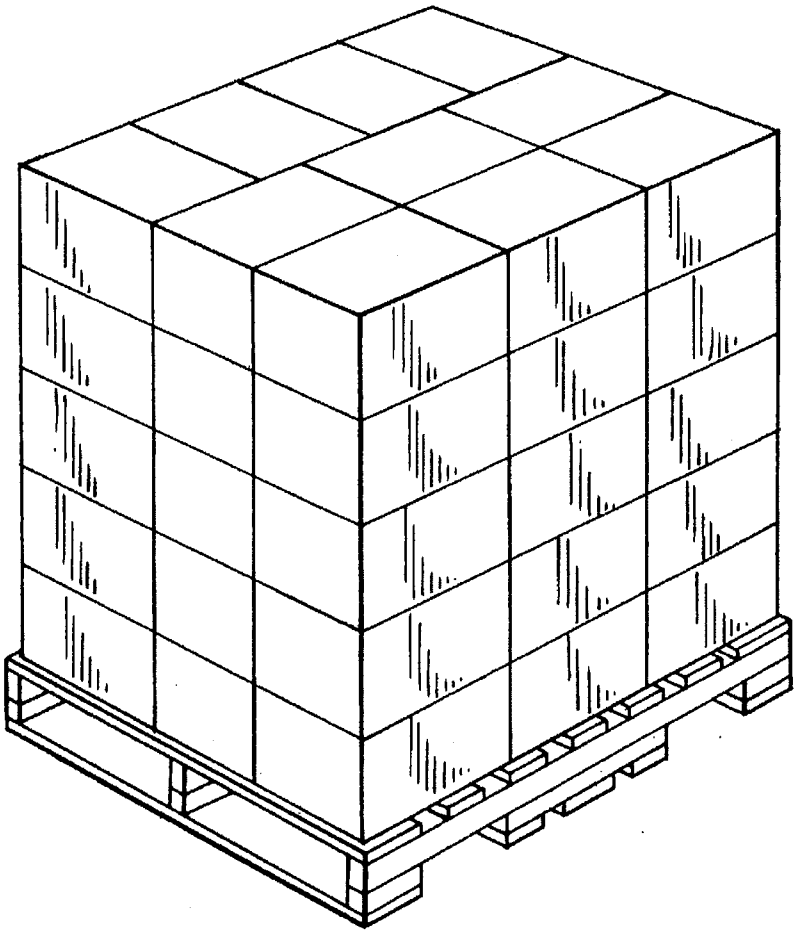
FIG. 10 is a diagrammatic view of containers stacked on a pallet in a columnar fashion.
Figure 9:
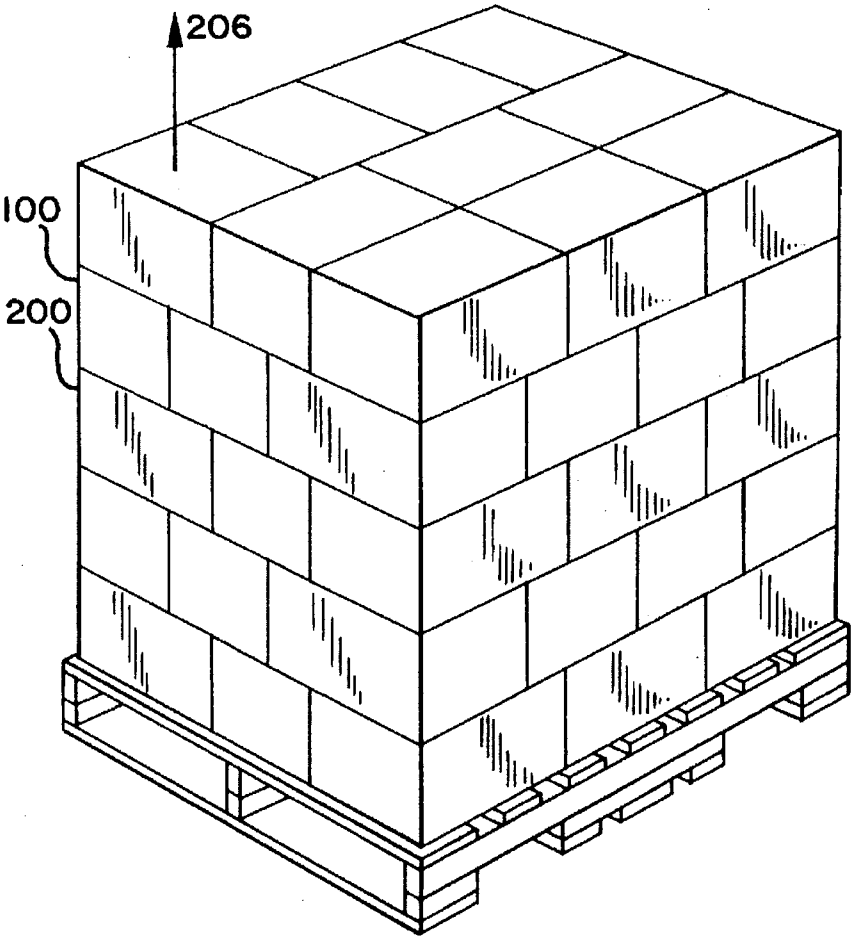
FIG. 9 is a diagrammatic view of containers stacked on a pallet in an interlocked fashion.

Because the major flaps 30 and 38 and minor flaps 64 are oriented along the axis in which the containers 100 will be stacked, or stacking axis 206, the containers 100 may be stacked on a pallet in an interlocking fashion (FIG. 9) instead of a columnar fashion (FIG. 10). The interlocking stacking arrangement allows for stacking containers 100 cross-wise on top of containers 200 located on a layer below.

Prior art containers such as the one shown in the '278 Patent, had insufficient structural support to be stacked in an interlocking fashion and had to be stacked in conformation with one another in a columnar stacking fashion shown in FIG. 10. The interlocking stacking arrangement (FIG. 9) provides a more stable palletized load than the columnar stacking arrangement (FIG. 10).

Further, because of the increased support gained through the orientation of the major flaps 30 and 38 and minor flaps 64, an internal surface 210 along panels 32 and 36 and side blanks 60 of container 100 is a continuous, and smooth surface without the need of internal flanges 120 shown in the '278 Patent.

Because of the increased structural support of the container 100, the container 100 may be used to ship single shipments using a common carrier such as U.P.S.

While the present container 100 has been described as generally rectangularly shaped, it is anticipated that the container could be constructed having various polygonal-shapes without departing from the present invention. Also, while the second end 104 of the rectangular sleeve 73 is closed by the cooperative folding of major and minor flaps, it is anticipated that a single sidewall could carry a flap that could close the container 100 or a separate cap could be used to close the container 100 without departing from the present invention.

While the specific embodiments have been illustrated and described, numerous modifications come to mind without significantly departing from the spirit of the invention and the scope of protection is only limited by the scope of the accompanying claims.

We claim:

1. A container comprising:

a plurality of sidewalls defining a polygonal-shaped sleeve, the sleeve having first and second ends, inner and outer surfaces, and a depth dimension and a width dimension, the depth dimension being greater than the width dimension;

a first end wall at the first end of the sleeve to close the first end of the sleeve;

a first parallel support having a pair of legs associated with a first sidewall along a portion of the depth of the container; and a second parallel support having a pair of legs associated with a second sidewall along a portion of the depth of the container.

2. The container of claim 1 wherein the sleeve has a smooth inner surface.

3. The container of claim 1 wherein a first, a second, a third and a fourth sidewalls define a rectangular shaped sleeve, wherein the first sidewall is opposite the third sidewall and the second sidewall is opposite the fourth sidewall.

4. The container of claim 3 wherein one of the walls has a hole to allow for the passage of air or liquid.

5. The container of claim 3 further comprising a first major flap hingedly connected to the first sidewall, wherein the first major flap defines a second end wall to close the second end of the sleeve.

6. The container of claim 5 further comprising an access door located on the first end wall.

7. The container of claim 5 further comprising an access door located on the second end wall.

8. The container of claim 5 further comprising an axis of stacking, wherein the second end wall is parallel to the axis of stacking.

9. The container of claim 5 further comprising a second major flap hingedly connected to the third sidewall, wherein the first major flap overlaps the second major flap to define a double second end wall.

10. The container of claim 9 further comprising an access door located on the first major flap, wherein:

the second flap has an aperture; and the access door overlaps the aperture.

11. The container of claim 9 further comprising:

a first access door located on the first major flap; and a second access door located on the second major flap wherein the first access door overlaps the second access door.

12. The container of claim 3 further comprising an end panel wherein:

the second sidewall and the fourth sidewall are connected by the end panel; and the first end wall overlaps the end panel to define a double first end wall.

13. The container of claim 3 further comprising:

a first end panel hingedly connected to the fourth sidewall at the first end of the container; and a second end panel hingedly connected to the second sidewall at the first end of the container;

wherein the first end wall overlaps the first and second end panels to define a double first end wall.

14. The container of claim 3 further comprising:

a first major flap hingedly connected to the first sidewall at the second end of the sleeve; and a second major flap hingedly connected to the third sidewall at the second end of the sleeve;

wherein the first major flap and the second major flap cooperate to define a second end wall to close the second end of the sleeve.

15. The container of claim 14 further comprising:

a first minor flap hingedly connected to the fourth sidewall at the second end of the sleeve; and a second minor flap hingedly connected to the second sidewall at the second end of the sleeve;

wherein the first major flap and the second major flap overlap the first minor flap and the second minor flap to form a double second end wall.

16. The container of claim 14 further comprising:

a first minor flap hingedly connected to the fourth sidewall at the second end of the sleeve; and a second minor flap hingedly connected to the second sidewall at the second end of the sleeve;

wherein the first minor flap and the second minor flap overlap the first major flap and the second major flap to form a double second end wall.

17. The container of claim 15 further comprising a first access door located on the first major flap.

18. The container of claim 17 wherein:

the first minor flap has a first notch;

the second minor flap has a second notch; and the first access door overlaps the first and second notch.

19. The container of claim 17 further comprising a second access door located on the first minor flap wherein the first access door overlaps the second access door.

20. The container of claim 15 further comprising an access door cooperatively formed on the first major flap and the second major flap.

21. The container of claim 1 further comprising:

a first side flap hingedly connected to the first end wall, wherein the first side flap extends across the width of the sleeve adjacent to the first parallel support to form a first C-shaped support; and a second side flap hingedly connected to the first end wall, wherein the second side flap extends across the width of the sleeve adjacent to the second parallel support to form a second C-shaped support.

22. The container of claim 1 further comprising:

a first side flap hingedly connected to the first end wall between the legs of the first parallel support to form a C-shaped support; and a second side flap hingedly connected to the first end wall between the legs of the second parallel support to form a C-shaped support.

23. The container of claim 1 further comprising a handle on the first end wall.

24. The container of claim 15 further comprising a handle on the first major flap.

25. The container of claim 24 wherein the second minor flap has an aperture and the handle overlaps the aperture.

26. A container comprising:

a first, a second, a third and a fourth sidewalls defining a rectangular sleeve, wherein the first sidewall is opposite the third sidewall and the second sidewall is opposite the fourth sidewall, the sleeve having first and second ends, inner and outer surfaces, and a depth dimension and a width dimension, the depth dimension being greater than the width dimension;

a first end wall at the first end of the sleeve to close the first end of the sleeve;

two sets of parallel supports each having two legs, one of each associated with the second and the fourth sidewalls along the depth of the container;

a first major flap hingedly connected to the first sidewall; and a second major flap hingedly connected to the third sidewall;

wherein the first major flap overlaps the second major flap to define a double second end wall.

27. The container of claim 26 further comprising two minor flaps, one of each hingedly connected to the second and the fourth sidewalls, wherein the first major flap and the second major flap overlap the two minor flaps.

28. The container of claim 27 further comprising an access door located on the first major flap, wherein:

the second major flap has an aperture;

the access door overlaps the aperture; and the minor flaps terminate short of the access door.

29. The container of claim 28 further comprising a handle on the first end wall.

30. The container of claim 29 wherein one of the walls has a hole to allow for the passage of air or liquid.

31. A container comprising:

a first, a second, a third, and a fourth sidewalls defining a rectangular shaped sleeve, wherein the first sidewall is opposite the third sidewall and the second sidewall is opposite the fourth sidewall, the sleeve having first and second ends, inner and outer surfaces, and a depth dimension and a width dimension, the depth dimension being greater than the width dimension;

a first end wall at the first end of the sleeve to close the first end of the sleeve;

two C-shaped supports, one of each associated with the second and the fourth sidewalls; and a first major flap and a second major flap, one of each hingedly connected to the first and the third sidewalls, wherein:

the first major flap is longer than the second major flap; and the first major flap and the second major flap cooperate to form a second end wall to close the second end of the sleeve.

32. The container of claim 31 further comprising two minor flaps, one of each hingedly connected to the second and the fourth sidewalls, wherein the first major flap and the second major flap overlap the two minor flaps.

33. The container of claim 32 further comprising:

a first access door located on the first major flap; and a second access door located on one of the minor flaps wherein the first access door overlaps the second access door.

34. The container of claim 33 further comprising a handle located on the first major flap proximate the first access door, wherein one of the minor flaps has an aperture and the handle overlaps the aperture.

35. The container of claim 34 wherein one of the walls has a hole to allow for the passage of air or liquid.

* * * * *